US008119581B2

(12) United States Patent
Fessenbecker et al.

(10) Patent No.: US 8,119,581 B2
(45) **Date of Patent: *Feb. 21, 2012**

(54) USE OF CROSSLINKED MICROGELS FOR MODIFYING THE TEMPERATURE-DEPENDENT BEHAVIOR OF NON-CROSSLINKABLE ORGANIC MEDIA

(75) Inventors: Achim Fessenbecker, Waghäusel (DE); Patrick Galda, Karlsruhe (DE); Torsten Ziser, Birkenau (DE); Thomas Früh, Limburgerhof (DE); Werner Obrecht, Moers (DE)

(73) Assignees: Rhein Chemie Rheinau GmbH, Mannheim (DE); LANXESS Deutschland GmbH, Leverkusen (DE)

( * ) Notice: Subject to any disclaimer, the term of this patent is extended or adjusted under 35 U.S.C. 154(b) by 1155 days.

This patent is subject to a terminal disclaimer.

(21) Appl. No.: 11/374,247

(22) Filed: Mar. 13, 2006

(65) Prior Publication Data

US 2006/0275690 A1 Dec. 7, 2006

(30) Foreign Application Priority Data

Mar. 24, 2005 (DE) ..... 10 2005 014 270

(51) Int. Cl.
*C10M 143/00* (2006.01)
*C10M 169/04* (2006.01)
*C08F 8/00* (2006.01)

(52) U.S. Cl. ..... 508/591; 508/138; 516/98; 525/191

(58) Field of Classification Search ..... 508/591, 508/138; 525/191; 516/98
See application file for complete search history.

(56) References Cited

U.S. PATENT DOCUMENTS

| | | | | |
|---|---|---|---|---|
| 2,187,146 | A | 1/1940 | Calcott et al. | 18/57 |
| 3,285,887 | A | 11/1966 | Vries | |
| 3,455,828 | A | 7/1969 | Lawrence et al. | |
| 3,455,829 | A | 7/1969 | Lawrence et al. | |
| 4,360,620 | A | 11/1982 | Lindner et al. | 524/234 |
| 5,124,408 | A | 6/1992 | Engels et al. | 525/215 |
| 5,238,977 | A | 8/1993 | Piejko et al. | 523/201 |
| 5,302,696 | A | 4/1994 | Schiessl | 528/487 |
| 5,395,891 | A | 3/1995 | Obrecht et al. | 525/194 |
| 5,442,009 | A | 8/1995 | Parker et al. | 524/555 |
| 6,127,488 | A | 10/2000 | Obrecht et al. | 525/333.3 |
| 6,133,364 | A | 10/2000 | Obrecht et al. | 524/495 |
| 6,184,296 | B1 | 2/2001 | Obrecht et al. | 525/232 |
| 6,207,757 | B1 | 3/2001 | Obrecht et al. | 525/194 |
| 6,237,333 | B1 * | 5/2001 | Lee et al. | 60/487 |
| 6,242,534 | B1 | 6/2001 | Obrecht et al. | 525/191 |

(Continued)

FOREIGN PATENT DOCUMENTS

EP 953 615 11/1999

(Continued)

OTHER PUBLICATIONS

European Search Report from co-pending Application 0611090437-2104/ 1721959 dated Aug. 16, 2010, 9 pages.

(Continued)

*Primary Examiner* — Jim Goloboy
(74) *Attorney, Agent, or Firm* — Nicanor A. Kohncke

(57) ABSTRACT

The invention relates to the use of microgels for modifying the temperature behavior of non-crosslinkable organic media, in particular in high temperature applications at least about 100° C., for example in engine oils, gear oils, etc.

24 Claims, 1 Drawing Sheet

MODE OF FUNCTIONING OF THE HOMOGENISER VALVE

U.S. PATENT DOCUMENTS

| | | | | |
|---|---|---|---|---|
| 6,372,857 | B1 | 4/2002 | Obrecht et al. | 525/332.6 |
| 6,399,706 | B1 | 6/2002 | Obrecht et al. | 525/191 |
| 6,548,454 | B1 * | 4/2003 | Yamamoto et al. | 508/138 |
| 6,573,346 | B1 | 6/2003 | Melchoirs et al. | 526/217 |
| 6,579,945 | B2 | 6/2003 | Obrecht et al. | 525/192 |
| 6,620,886 | B2 | 9/2003 | Obrecht et al. | 525/191 |
| 6,632,888 | B2 | 10/2003 | Obrecht et al. | 525/215 |
| 6,649,696 | B2 | 11/2003 | Obrecht et al. | 525/125 |
| 6,737,478 | B2 | 5/2004 | Obrecht et al. | 525/133 |
| 7,842,732 | B2 * | 11/2010 | Ziser et al. | 516/98 |
| 2001/0051685 | A1 | 12/2001 | Obrecht et al. | 524/526 |
| 2002/0082364 | A1 | 6/2002 | Obrecht et al. | 525/535 |
| 2003/0088036 | A1 | 5/2003 | Huang et al. | 525/523 |
| 2005/0197443 | A1 * | 9/2005 | Ziser et al. | 524/474 |
| 2006/0252858 | A1 | 11/2006 | Obrecht et al. | 524/160 |
| 2006/0254734 | A1 | 11/2006 | Hannay et al. | 162/134 |
| 2006/0275691 | A1 | 12/2006 | Fessenbecker et al. | 430/137.15 |
| 2007/0135573 | A1 | 6/2007 | Ziser et al. | 525/119 |
| 2007/0232733 | A1 | 10/2007 | Ziser et al. | 524/386 |
| 2008/0064768 | A1 | 3/2008 | Ziser et al. | |
| 2008/0249241 | A1 | 10/2008 | Heiliger et al. | 525/50 |

FOREIGN PATENT DOCUMENTS

| | | |
|---|---|---|
| EP | 1 262 510 | 2/2007 |
| GB | 1078400 | 8/1967 |
| WO | WO 2005030843 A1 * | 4/2005 |

OTHER PUBLICATIONS

Chinese Journal of Polymer Science, vol. 20, No. 2 (2002), 93-98 Special Effect of Ultra Fine Rubber Particles on Plastic Toughening.

H.G. Elias, Makromolekule, vol. 2,Technologie, 5th Edition, 1992, pp. 99 ff.

Ullmanns Enzyklopadie der technischen Chemie, Verlag Chemie Weinheim, vol. 20 (1981) 457 ff.; 504, 507 ff; 517/518, 524.

Houben-Weyl, Methoden der organischen Chemie, 4th Edition, vol. 14/2, p. 848, 1963.

Brock, Thomas, Groteklaes, Michael, Mischke, Peter, Lehrbuch der Lacktechnologie, Curt R. Vincentz Hannover (1998) 93 ff.

William D. Pandolfe, Peder Baekgaard, Marketing Bulleting from APV Homogenizer Group—"High-pressure homogenizers, processes, product and applications", 1997.

* cited by examiner

MODE OF FUNCTIONING OF THE HOMOGENISER VALVE
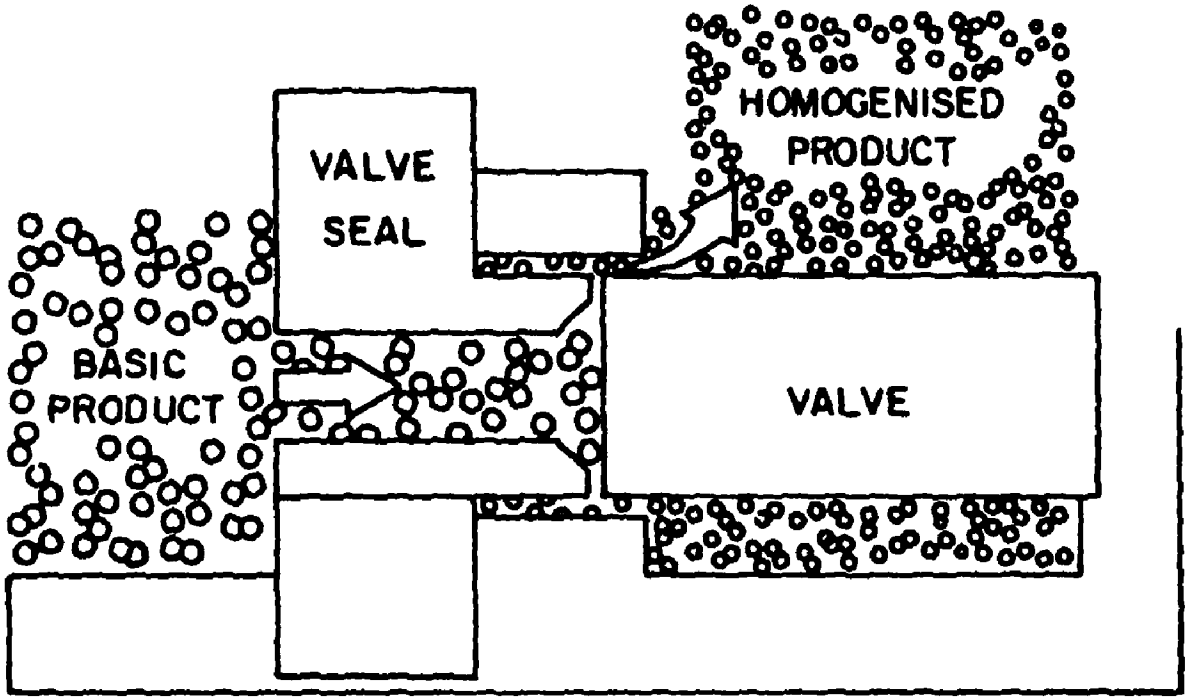

USE OF CROSSLINKED MICROGELS FOR MODIFYING THE TEMPERATURE-DEPENDENT BEHAVIOR OF NON-CROSSLINKABLE ORGANIC MEDIA

The present invention relates to the use of microgels for modifying the temperature behavior of non-crosslinkable organic media, in particular in high-temperature applications at at least about 100° C., such as in engine oils, gear oils, etc.

It is known to use rubber gels, and also modified rubber gels, in a very wide range of applications. Thus, for example, rubbers are used in order to improve for example the rolling resistance in the manufacture of vehicle tires (see for example DE 42 20 563, GB-PS 10 78 400, EP 405 216 and EP 854 171). In this connection the rubber gels are always incorporated into solid matrices.

It is also known to incorporate in finely distributed form printing ink pigments into liquid media suitable for this purpose, in order ultimately to produce printing inks (see for example EP 0 953 615 A2, EP 0 953 615 A3). In this case particle sizes of down to 100 nm are achieved.

In Chinese Journal of Polymer Science, Vol. 20, No. 2, (2002), 93-98, microgels completely crosslinked by high-energy radiation and their use to increase the impact toughness of plastics materials are described. US 20030088036 A1 discloses reinforced, heat-curing resin compositions, in the production of which similarly radiation-crosslinked microgel particles are mixed with heat-curing prepolymers (see also EP 1262510 A1).

Dispersions of rubber particles with organic solvents are known from DE 2910154.

Dispersions of silicon-containing graft polymers in liquid amides are known from DE-A-3742180.

Microgel-containing compositions have basically been described in the non-published international application PCT/EP2004/052290 in the name of the present applicant.

The inventors of the present invention have now found that microgels in particular improve the temperature-dependent rheological behavior of non-crosslinkable organic media, in particular at high temperatures of at least about 100° C., and thus open up new possible uses of the microgels, for example in engine oils, gear oils, etc. In this connection use is made in particular of the nano properties of the employed microgels.

Thus, compositions according to the invention surprisingly exhibit extremely interesting temperature-dependent rheological properties if the microgels are used in low concentrations in these compositions.

The present invention thus relates to the use of crosslinked microgels (B) as additive for non-crosslinkable organic media (A) for application at temperatures of at least 100° C., preferably at least about 200° C. and more particularly preferably at least about 300° C., and in particular the use as rheological additive. The aforementioned temperatures are temperatures to which the composition comprising the microgel (B) and non-crosslinkable organic media (A) are subjected during use, or temperatures that the aforementioned composition reaches intermittently or continuously during use.

The present invention thus relates furthermore to the use of crosslinked microgels (B) as additive for modifying the temperature-dependent behavior of non-crosslinkable organic media (A), in particular the temperature-dependent behavior that is characterized by the kinematic viscosities at 40° C. and 100° C. of the composition comprising crosslinked microgels (B) and non-crosslinkable organic media (A).

According to the invention, in particular the viscosity of non-crosslinkable organic media at high temperatures of at least about 100° C. is raised by the addition of the microgel (B).

In other words, the invention also relates to the use of crosslinked microgels (B) as additive in non-crosslinkable organic media (A) for high temperature applications that are selected from the group comprising: engine oils, gear oils, hydraulic oils, turbine oils, compressor oils, industrial oils, metal-working fluids and chainsaw oils. The aforementioned non-crosslinkable organic media are employed in particular at temperatures of more than 100° C., preferably at least about 200° C. and more preferably at least about 300° C. The aforementioned temperatures are temperatures to which the composition of microgel (B) and non-crosslinkable organic media (A) is subjected during use, or temperatures that are intermittently or permanently reached by the aforementioned composition during use.

In particular the invention relates to the use of crosslinked microgels (B) for modifying the temperature-dependent behavior of non-crosslinkable organic media (A), in which by the addition of the microgel (B) the characteristic number determined from the viscosities of the non-crosslinkable organic medium (A) at 40° C. and 100° C. is raised by at least 10%, preferably by at least 50%, more preferably by at least 100% and particularly preferably by 300%, the characteristic number being determined as follows:

$$\text{Characteristic number}=[(L-U)/(L-H)]\times 100$$

wherein

L is the kinematic viscosity at 40° C. of a reference medium with the characteristic number 0, which has the same kinematic viscosity at 100° C. as the non-crosslinkable medium (A) to be determined;

H is the kinematic viscosity at 40° C. of a reference medium with the characteristic number 100, which has the same kinematic viscosity at 100° C. as the non-crosslinkable medium to be determined; and U is the kinematic viscosity at 40° C. of the non-crosslinkable medium to be determined.

The determination of the kinematic viscosity is in this connection carried out according to DIN 51562-1 "Measurement of the Kinematic Viscosity with the Ubbelohde Viscosimeter".

It has been found that this characteristic number can be significantly raised for microgel-containing lubricants compared to the pure lubricant; for example, a 2% addition of the microgel Micromorph 5 P to the oil Nynas T110 leads to an increase in the characteristic number of over 400%. Fluids modified in this way exhibit a significantly altered and improved temperature dependence of the viscosity. Thus, in the range of low temperatures, such as below about −10° C., the original viscosity of the organic medium remains virtually unchanged, while at higher temperatures, such as above 100° C., a sufficient viscosity value is reached. This ensures the formation of a very uniform liquid film over a wide temperature range, which is very attractive particularly in the motor oils sector, where the lubricating behavior during cold starting can however also be favourably influenced in the high temperature range.

In addition the aforedescribed compositions may exhibit properties such as an excellent shear stability and outstanding transparency, which means that commercially very interesting products can be obtained.

The non-crosslinkable organic medium (A) preferably has at a temperature of 120° C. a viscosity of less than 30,000 mPas. More preferably the viscosity of the non-crosslinkable organic medium (A) is less than 1000 mPas, still more preferably less than 200 mPas, even more preferably less than 100 mPas at 120° C., and most preferably less than 20 mPas at 120° C. The dynamic viscosity of the non-crosslinkable organic medium (A) is determined at a rotational speed of 5 $s^{-1}$ with a cone-plate measuring system according to DIN 53018 at 120° C.

Microgels (B)

The microgel (B) used according to the invention is in particular a crosslinked microgel. In a preferred embodiment it is not a microgel that has been crosslinked by high-energy radiation. High-energy radiation means in this case normally electromagnetic radiation having a wavelength of less than 0.1 μm. The use of microgels crosslinked by high-energy radiation, as described for example in Chinese Journal of Polymer Science, Vol. 20, No. 2, (2002), 93-98, is disadvantageous since microgels crosslinked by high-energy radiation cannot in practice be produced on an industrial scale. Furthermore, serious safety problems arise in the use of high-energy radiation from radioactive radiation sources such as radioactive cobalt.

In a preferred embodiment of the invention the primary particles of the microgel (B) have an approximately spherical geometry. According to DIN 53206: 1992-08 primary particles dispersed in the coherent phase and recognizable as individual particles by suitable physical processes (electron microscopy) are classed as microgel particles (see for example Römpp Lexikon, Lacke und Druckfarben, Georg Thieme Verlag, 1998). An "approximately spherical" geometry means that when the composition is viewed, for example with an electron microscope, the dispersed primary particles of the microgels form an image having a recognizably substantially circular surface. Since the microgels basically do not change their shape or morphology when incorporated into the compositions, the comments made hereinbefore and hereinafter apply in the same way also to the microgel-containing compositions.

With the microgels (B) that are used according to the invention the deviation of the diameters of an individual primary particle of the microgel, defined as $$[(d1-d2)/d2]\times 100,$$

wherein d1 and d2 are two arbitrary diameters of the primary particle and d1>d2, is preferably less than 250%, more preferably less than 100%, even more preferably less than 80% and most preferably less than 50%.

Preferably at least 80%, more preferably at least 90% and even more preferably at least 95% of the primary particles of the microgel exhibit a deviation of the diameters, defined as $$[(d1-d2)/d2]\times 100,$$

wherein d1 and d2 are two arbitrary diameters of the primary particle and d1>d2, of less than 250%, preferably less than 100%, more preferably less than 80% and still more preferably less than 50%.

The aforementioned deviation of the diameters of the individual particles may be determined by the following method. A thin section of the consolidated composition according to the invention is first of all produced. A transmission electron microscopy image is then taken at a magnification of for example 10,000× or 200,000×. In a surface area of 833.7× 828.8 nm the largest and the smallest diameter, d1 and d2 respectively, are determined in 10 microgel primary particles. If the deviation defined above in at least 80%, preferably at least 90% and even more preferably at least 95% of the measured microgel primary particles is in each case below 250%, preferably below 100%, more preferably less than 80% and even more preferably less than 50%, then the microgel primary particles exhibit the deviation feature defined above.

If in the composition the concentration of the microgels is so high that the visible microgel primary particles are to a large extent superimposed on one another, the evaluability can be improved by prior, suitable dilution of the measurement sample.

The primary particles of the microgel (B) preferably have an average particle diameter of 5 to 500 nm, more preferably 20 to 400 nm, still more preferably 20 to 300 nm, yet more preferably 20 to 250 nm, even more preferably 20 to 99 nm and most preferably 40 to 80 nm (diameter data according to DIN 53206). The production of particularly finely particulate microgels by emulsion polymerization is carried out by controlling the reaction parameters in a manner known per se (see for example H. G. Elias, Makromoleküle, Vol. 2, Technologie, $5^{th}$ Edition, 1992, pp. 99 ff).

Since the morphology of the microgels remains substantially unchanged in the incorporation into the non-crosslinkable organic medium (A), the average particle diameter of the dispersed primary particles corresponds substantially to the average particle diameter of the dispersed primary particles in the compositions and in the products produced therefrom, such as engine oils, etc. The microgels (B) used according to the invention expediently contain fractions (gel content) insoluble in toluene at 23° C. of at least about 70 wt. %, preferably at least about 80 wt. % and more preferably at least about 90 wt. %.

The fraction insoluble in toluene is in this connection determined in toluene at 23° C. For this, 250 mg of the microgel are caused to swell at 23° C. in 20 ml of toluene for 24 hours while shaking. After centrifugation at 20,000 rpm the insoluble fraction is separated and dried. The gel content is calculated from the quotient of the dried residue and the amount weighed out, and is specified in weight percent.

The microgels (B) used according to the invention expediently have a swelling index in toluene at 23° C. of less than about 80, more preferably of less than 60, and even more preferably of less than 40. Thus, the swelling indices (SI) of the microgels may particularly preferably be between 1-15 and 1-10. The swelling index is calculated from the weight of the solvent-containing microgel swelled in toluene at 23° C. for 24 hours (after centrifugation at 20,000 rpm) and the weight of the dried microgel:

SI=wet weight of the microgel/dry weight of the microgel.

To determine the swelling index 250 mg of the microgel are caused to swell in 25 ml of toluene for 24 hours while shaking. The gel is centrifuged off and weighed and is then dried at 70° C. to constant weight and weighed once more.

The microgels (B) used according to the invention expediently have glass transition temperatures Tg from −100° C. to +120° C., more preferably from −100° C. to +100° C. and even more preferably from −80° C. to +80° C. In rare cases microgels may also be used that do not have a glass transition temperature on account of their high degree of crosslinking.

The microgels (B) used according to the invention preferably have a glass transition range of >5° C., more preferably >10° C. and even more preferably >20° C.

The determination of the glass transition temperatures (Tg) and the glass transition range (ΔTg) of the microgels is carried out by Differential Scanning Calorimetry (DSC) under the following conditions: to determine Tg and ΔTg, two cooling/heating cycles are carried out. Tg and ΔTg are determined in the second heating cycle. For the determinations 10-12 mg of the selected microgel are placed in a DSC sample holder (standard aluminum pan) from Perkin-Elmer. The first DSC cycle is carried out by first cooling the sample with liquid nitrogen to −100° C. and then heating the sample at a rate of 20 K/min to +150° C. The second DSC cycle is started by immediately cooling the sample as soon as a sample temperature of +150° C. has been reached. The cooling is carried out at a rate of about 320 K/min. In the second heating cycle the sample is heated, as in the first cycle, once more to +150° C. The heating rate in the second cycle is again 20 K/min. Tg and are determined graphically from the DSC curve of the second heating procedure. For this purpose three straight lines are drawn on the DSC curve. The first straight line is drawn on the curved part of the DSC curve below Tg, the second straight line is drawn on the branch of the curve containing the point of inflection and passing through Tg, and the third straight line is drawn on the branch of the DSC curve above Tg. In this way three straight lines with two points of intersection are obtained. Both points of intersection are in each case characterized by a characteristic temperature. The glass transition temperature Tg is obtained as the mean value of these two temperatures, and the glass transition range ΔTg is obtained from the difference of the two temperatures.

The microgels used according to the invention may be produced in a manner known per se (see for example EP-A-405 216, EP-A-854171, DE-A 4220563, GB-PS 1078400, DE 197 01 489.5, DE 197 01 488.7. DE 198 34 804.5, DE 198 34 803.7, DE 198 34 802.9, DE 199 29 347.3, DE 199 39 865.8, DE 199 42 620.1, DE 199 42 614.7, DE 100 21 070.8, DE 100 38 488.9, DE 100 39 749.2, DE 100 52 287.4, DE 100 56 311.2 and DE 100 61 174.5). The use of CR, BR and NBR microgels in mixtures with rubbers containing double bonds is claimed in the patent applications EP-A 405 216, DE-A 4220563 as well as in GB-PS 1078400. DE 197 01 489.5 describes the use of subsequently modified microgels in mixtures with rubbers containing double bonds, such as NR, SBR and BR.

Microgels are conveniently understood to mean rubber particles that are obtained in particular by crosslinking the following rubbers:

| | |
|---|---|
| BR: | polybutadiene, |
| ABR: | butadiene/acrylic acid C1-4 alkyl ester copolymers, |
| IR: | polyisoprene, |
| SBR: | styrene-butadiene copolymers with styrene contents of 1-60, preferably 5-50 wt. %, |
| X-SBR: | carboxylated styrene-butadiene copolymers, |
| FKM: | fluorine-containing rubber, |
| ACM: | acrylate rubber, |
| NBR: | polybutadiene-acrylonitrile copolymers with acrylonitrile contents of 5-60, preferably 10-50 wt. %, |
| X-NBR: | carboxylated nitrile rubbers, |
| CR: | polychloroprene, |
| IIR: | isobutylene/isoprene copolymers with isoprene contents of 0.5-10 wt. %, |
| BIIR: | brominated isobutylene/isoprene copolymers with bromine contents of 0.1-10 wt. %, |
| CIIR: | chlorinated isobutylene/isoprene copolymers with chlorine contents of 0.1-10 wt. %, |
| HNBR: | partially hydrogenated and fully hydrogenated nitrile rubbers, |
| EPDM: | ethylene-propylene-diene copolymers, |
| EAM: | ethylene/acrylate copolymers, |
| EVM: | ethylene/vinyl acetate copolymers |
| CO and ECO: | epichlorohydrin rubbers, |
| Q: | silicone rubbers, with the exception of silicone graft polymers, |
| AU: | polyester urethane polymers, |
| EU: | polyether urethane polymers, |
| ENR: | epoxydised natural rubber or mixtures thereof. |

The production of the non-crosslinked microgel starting products is conveniently carried out by the following methods:

1. emulsion polymerization,
2. solution polymerization of rubbers that are not accessible via variant 1,
3. also, naturally-occurring latices such as for example natural rubber latex may be used.

The microgels (B) that are used are preferably those that are obtainable by emulsion polymerization and crosslinking.

In the production of the microgels used according to the invention by emulsion polymerization, the following, free-radically polymerizable monomers are for example used:: butadiene, styrene, acrylonitrile, isoprene, esters of acrylic and methacrylic acid, tetrafluoroethylene, vinylidene fluoride, hexafluoropropene, 2-chlorobutadiene, 2,3-dichlorobutadiene as well as carboxylic acids containing double bonds, such as e.g. acrylic acid, methacrylic acid, maleic acid, itaconic acid, etc., hydroxyl compounds containing double bonds, such as e.g. hydroxyethyl methacrylate, hydroxyethyl acrylate, hydroxybutyl methacrylate, amine-functionalized (meth)acrylates, acrolein, N-vinyl-2-pyrollidone, N-allylurea and N-allyl-thiourea, as well as secondary amino-(meth) acrylic acid esters such as 2-tert.-butylaminoethyl methacrylate and 2-tert.-butylaminoethyl methacrylamide, etc. The crosslinking of the rubber gel may be achieved directly during the emulsion polymerization, as well as by copolymerization with multifunctional compounds having a crosslinking effect or by subsequent crosslinking as described hereinafter. Direct crosslinking is a preferred embodiment of the invention. Preferred multifunctional comonomers are compounds containing at least 2, preferably 2 to 4 copolymerizable C═C double bonds, such as diisopropenylbenzene, divinylbenzene, divinyl ether, divinylsulfone, diallyl phthalate, triallyl cyanurate, triallyl isocyanurate, 1,2-polybutadiene, N,N'-m-phenylenemaleimide, 2,4-toluylenebis(maleimide) and/or triallyl trimellitate. Also suitable are the acrylates and methacrylates of polyhydric, preferably dihydric to tetrahydric C2 to $C_{10}$ alcohols, such as ethylene glycol, propanediol-1,2, butanediol, hexanediol, polyethylene glycol with 2 to 20, preferably 2 to 8 oxyethylene units, neopentyl glycol, bisphenol A, glycerol, trimethylolpropane, pentaerythritol, sorbitol with unsaturated polyesters of aliphatic diols and polyols, as well as maleic acid, fumaric acid and/or itaconic acid.

The crosslinking to form rubber microgels during the emulsion polymerization may also be carried out by continuing the polymerization up to high conversions or may be carried out in the monomer feed procedure by polymerization with high internal conversions. Another possibility is also to carry out the emulsion polymerization in the absence of regulators.

For the crosslinking of the non-crosslinked or slightly crosslinked microgel starting products subsequent to the emulsion polymerization, it is best to use the latices that are obtained in the emulsion polymerization. In principle this method can also be employed with non-aqueous polymer dispersions that are obtainable in another way, for example by melting. Also, natural rubber latices can be crosslinked in this way.

Suitable compounds having a crosslinking action are for example organic peroxides such as dicumyl peroxide, t-butyl cumyl peroxide, bis-(t.-butyl-peroxylisopropyl)benzene, di-t.-butyl peroxide, 2,5-dimethylhexane-2,5-dihydroperoxide, 2,5-dimethylhexyne-3,2,5-dihydroperoxide, dibenzoyl peroxide, bis-(2,4-dichlorobenzoyl)peroxide, t.-butyl perbenzoate, as well as organic azo compounds such as azo-bis-isobutyronitrile and azo-bis-cyclohexanenitrile, and also dimercapto and polymercapto compounds such as dimercaptoethane, 1,6-dimercaptohexane, 1,3,5-trimercaptotriazine and mercapto-terminated polysulfide rubbers such as mercapto-terminated reaction products of bis-chloroethyl formate with sodium polysulfide.

The optimal temperature for carrying out the post-crosslinking depends of course on the reactivity of the crosslinking agent, and may be carried out at temperatures ranging from room temperature up to ca. 180° C., optionally under increased pressure (see in this connection Houben-Weyl, Methoden der organischen Chemie, $4^{th}$ Edition, Vol. 14/2, page 848). Particularly preferred crosslinking agents are peroxides.

The crosslinking of rubbers containing C═C double bonds to form microgels may also be carried out in dispersion or emulsion with simultaneous partial or complete hydrogenation of the C═C double bond by hydrazine, as is described in U.S. Pat. Nos. 5,302,696 or 5,442,009, or optionally other hydrogenation agents, for example organometal hydride complexes.

A particle enlargement by agglomeration may optionally be carried out before, during or after the post-crosslinking.

In the production process without using high-energy radiation that is preferably employed according to the invention, microgels that are not completely homogeneously crosslinked and that may have the advantages described above are always obtained.

Also, rubbers that are produced by solution polymerization may serve as starting products for the production of the microgels. In these cases the solutions of these rubbers in suitable organic solutions are used as starting materials.

The desired sizes of the microgels are obtained by mixing the rubber solution by means of suitable equipment in a liquid medium, preferably in water and optionally under the addition of suitable surface-active substances such as for example surfactants, so that a dispersion of the rubber in the appropriate particle size range is obtained. For the crosslinking of the dispersed solution rubbers the procedure as described hereinbefore for the subsequent crosslinking of emulsion polymers is adopted. Suitable crosslinking agents are the previously-mentioned compounds, in which the solvent used for the production of the dispersion may if necessary be removed before the crosslinking, for example by distillation.

As microgels there may according to the invention be used non-modified microgels that basically contain no reactive groups, in particular on the surface, as well as microgels that are modified with functional groups, in particular on the surface. The latter can be produced by chemical reaction of the already crosslinked microgels with compounds that are reactive to C═C double bonds. These reactive compounds are in particular those compounds with the aid of which polar groups such as for example aldehyde, hydroxyl, carboxyl, nitrile, etc. as well as sulfur-containing groups such as for example mercapto, dithiocarbamate, polysulfide, xanthogenate, thiobenzthiazole and/or dithiophosphoric acid groups and/or unsaturated dicarboxylic acid groups can be chemically bound to the microgels. This also applies to N,N'-m-phenylenediamine. The purpose of the microgel modification is in particular to improve the microgel compatibility for the production of the matrix into which the microgel is incorporated. Particularly preferred methods of modification are grafting of the microgels with functional monomers as well as reaction with low molecular weight agents.

For the grafting of the microgels with functional monomers it is convenient to start from the aqueous microgel dispersion, which is reacted with polar monomers such as acrylic acid, methacrylic acid, itaconic acid, hydroxyethyl (meth)acrylate, hydroxypropyl (meth)acrylate, hydroxybutyl (meth)acrylate, acrylamide, methacrylamide, acrylonitrile, acrolein, N-vinyl-2-pyrollidone, N-allylurea and N-allylthiourea as well as secondary amino-(meth)acrylic acid esters such as 2-tert.-butylaminoethyl methacrylate and 2-tert.-butylaminoethyl methacrylamide, under the conditions of a free-radical emulsion polymerization. In this way microgels with a core/shell morphology are obtained, in which the shell should exhibit a high compatibility for the matrix. It is desirable that the monomer used in the modification step be grafted as quantitatively as possible onto the unmodified microgel. The functional monomers are conveniently metered in before the complete crosslinking of the microgels.

In principle a grafting of the microgels in non-aqueous systems is also conceivable, whereby in this way a modification with monomers by ionic polymerization methods is also possible.

The following substances in particular are suitable for a surface modification of the microgels with low molecular weight agents: elemental sulfur, hydrogen sulfide and/or alkylpolymercaptanes such as 1,2-dimercaptoethane or 1,6-dimercaptohexane, also dialkyl- and dialkylaryldithio carbamates such as the alkali metal salts of dimethyldithiocarbamate and/or dibenzyldithiocarbamate, in addition alkyl and aryl xanthogenates such as potassium methyl xanthogenate and sodium isopropyl xanthogenate, as well as the reaction products with the alkali metal or alkaline earth metal salts of dibutyidithiophosphoric acid and dioctyldithiophosphoric acid and also dodecyidithio-phosphoric acid. The aforementioned reactions may advantageously also be carried out in the presence of sulfur, the sulfur being incorporated with the formation of polysulfidic bonds. Radical starters such as organic and inorganic peroxides and/or azo initiators may be added for the addition of this compound.

It is also possible to carry out a modification of microgels containing double bonds, for example by ozonolysis as well as by halogenation with chlorine, bromine and iodine. Moreover, a further reaction of modified microgels, such as for example the production of hydroxyl group-modified microgel from epoxidized microgels, is understood as chemical modification of microgels.

In a preferred embodiment the microgels are modified by hydroxyl groups, in particular also on their surface. The hydroxyl group content of the microgels is measured as the hydroxyl number, having the dimensions of mg KOH/g of polymer, by reaction with acetic anhydride and titration of the acetic acid thereby released with KOH according to DIN 53240. The hydroxyl number of the microgels is preferably between 0.1 and 100 mg KOH/g of polymer, more preferably between 0.5 and 50 mg KOH/g of polymer.

The amount of the modification agent that is used is governed by its effectiveness and the requirements placed on the individual application, and is in the range from 0.05 to 30 wt. %, referred to the total amount of rubber microgel used, particularly preferably 0.5 to 10 wt. % referred to the total amount of rubber gel.

The modification reactions may be carried out at temperatures from 0 to 180° C., preferably 200 to 95° C., optionally under pressures from 1 to 30 bar. The modifications may be carried out on rubber microgels in bulk or in the form of a dispersion, in which connection in the latter case inert organic solvents or also water may be used as reaction medium. The modification is particularly preferably carried out in an aqueous dispersion of the crosslinked rubber.

The use of unmodified microgels is preferred in particular in non-polar media.

The use of modified microgels is preferred in particular for incorporation in polar media.

The mean diameter of the produced microgels can be adjusted with a high degree of accuracy, for example to 0.1 micrometer (100 nm) ±0.01 micrometer (10 nm), so that for example a particle size distribution is achieved in which at least 75% of all microgel particles are between 0.095 micrometer and 0.105 micrometer in size. Other mean diameters of the microgels especially in the range between 5 and 500 nm can be produced with the same accuracy (at least 75 wt. % of all particles lie around the maximum of the integrated grain size distribution curve (determined by light scattering measurements) in a range of ±10% above and below the maximum), and used. In this way the morphology of the microgels dispersed in the composition according to the invention can be adjusted to practically "pinpoint" accuracy and in this way the properties of the composition according to the invention as well as of the plastics produced for example therefrom can be adjusted.

The microgels produced in this way and preferably based on BR, SBR, NRB, SNBR or acrylonitrile or ABR may be worked up for example by concentration by evaporation, coagulation, by co-coagulation with a further latex polymer, by freeze coagulation (see U.S. Pat. No. 2,187,146) or by spray drying. When working up by spray drying conventional antiblocking agents such as for example $CaCO_3$ or silicic acid may also be added.

In a preferred embodiment the microgel (B) is based on rubber.

In a preferred embodiment the microgel (B) is modified by functional groups that are reactive to C═C double bonds.

In a preferred embodiment the microgel (B) has a swelling index in toluene at 23° C. of 1 to 15.

The composition used according to the invention comprising microgel (B) and non-crosslinkable medium (A) preferably has a viscosity of 2 mPas up to 50,000,000 mPas, more preferably 50 mPas up to 3,000,000 mPas, at a rotational speed of 5 $s^{-1}$, measured with a cone and plate viscosimeter according to DIN 53018, at 20° C.

Organic Non-Crosslinkable Medium (A)

The composition according to the invention contains at least one organic medium (A), which preferably has a viscosity of less than 30,000 mPas, more preferably less than 1000 mPas, still more preferably less than 200 mPas, even more preferably less than 100 mPas and most preferably less than 20 mPas, at 120° C.

Such a medium is liquid to solid at room temperature (20° C.), preferably liquid or flowable.

Organic medium within the meaning of the invention means that the medium contains at least one carbon atom.

Non-crosslinkable media within the meaning of the invention are understood to be in particular those media that do not contain groups crosslinkable via functional groups containing heteroatoms or via C═C groups, such as in particular conventional monomers or prepolymers that are crosslinked or polymerized in a conventional way by free-radicals, with UV radiation, thermally and/or by polyaddition or polycondensation under the addition of crosslinking agents (for example polyisocyanates, polyamines, acid anhydrides) etc., with the formation of oligomers or polymers in a conventional manner. According to the invention, as organic, non-crosslinkable media there may also be used those media that, although they contain for example specific proportions of unsaturated bonds (certain polyester oils, rapeseed oil, etc.) or hydroxy groups (polyethers), nevertheless they cannot be crosslinked or polymerized in a conventional way to oligomers or polymers.

The non-crosslinkable medium (A) is preferably non-crosslinkable media liquid at room temperature (20° C.), in particular those that boil at temperatures of more than 100° C., more preferably at more than 200° C., even more preferably more than 300° C. and most preferably more than 350° C. at normal pressure (1 bar), such as hydrocarbons (straight-chain, branched, cyclic, saturated, unsaturated and/or aromatic hydrocarbons with 1 to 200 carbon atoms, which may optionally be substituted by one or more substituents selected from halogens such as chlorine, fluorine, or hydroxy, oxo, amino, carboxy, carbonyl, aceto, amido), synthetic hydrocarbons, polyether oils, ester oils, phosphoric acid esters, silicon-containing oils and halogenated hydrocarbons and carbon halides (see for example Ullmanns Enzyklopädie der technischen Chemie, Verlag Chemie Weinheim, Vol. 20, (1981) 457 ff, 504, 507 ff, 517/518, 524). These non-crosslinkable media (A) are characterized in particular by viscosities of 2 to 1500 $mm^2$/sec (cSt) at 40° C. The synthetic hydrocarbons are obtained by polymerization of olefins, condensation of olefins or chloroparaffins with aromatic compounds, or dechlorinating condensation of chloroparaffins. Examples in the case of polymer oils are ethylene polymers, propylene polymers, polybutenes, polymers of higher olefins, and alkyl aromatic compounds. The ethylene polymers have molecular weights between 400 and 2000 g/mole. The polybutenes have molecular weights between 300 and 1500 g/mole.

In the case of the polyether oils a distinction is made between aliphatic polyether oils, polyalkylene glycols, in particular polyethylene and polypropylene glycols, their copolymers, their monoethers and diethers, as well as ester ethers and diesters, tetrahydrofuran polymer oils, perfluoropolyalkyl ethers and polyphenyl ethers. Perfluoropolyalkyl ethers have molecular weights from 1000 to 10,000 g/mole. The aliphatic polyether oils have viscosities from 8 to 19,500 $mm^2$/sec at 38° C.

Polyphenylene ethers are produced by condensation of alkali metal phenolates with halogenated benzenes. The diphenyl ether and its alkyl derivatives may also be used.

Examples of the ester oils are the alkyl esters of adipic acid, bis-(2-ethylhexyl)-sebacate and bis-(3,5,5-trimethylhexyl)-sebacate or adipate, as well as the esters of natural fatty acids with monohydric or polyhydric alcohols, such as TMP oleate. Fluorine-containing ester oils form a further class. In the case of phosphoric acid esters a distinction is made between triaryl, trialkyl and alkylaryl phosphates. Examples include tri-(2-ethylhexyl)-phosphate and bis-(2-ethylhexyl)-phenylphosphate.

Silicon-containing oils include silicone oils (polymers of the alkyl and aryl siloxane series) and silicic acid esters.

Examples of renewable non-crosslinkable organic media are rapeseed oil and sunflower oil.

The halogenated hydrocarbons and carbon halides include chlorinated paraffins such as chlorotrifluoroethylene polymer oils and hexafluorobenzene.

(Non-reactive) solvents according to DIN55 945 are hexane, special boiling point spirits, white spirits, xylene, solvent naphtha, gum spirit of turpentine, methyl ethyl ketone, methyl isobutyl ketone, methyl amyl ketone, isophorone, butyl acetate, 1-methoxypropyl acetate, butyl glycol acetate, ethyl diglycol acetate and N-methylpyrrolidone (Brock, Thomas, Groteklaes, Michael, Mischke, Peter, Lehrbuch der Lacktechnologie, Curt R. Vincentz Verlag Hannover, (1998) 93 ff), but not toluene.

Particularly preferred non-crosslinkable media include: polyethers, e.g. Baylube 68CL, naphthenic oils, e.g. Nynas T 110, paraffinic, highly refined mineral oils, e.g. Shell Catenex S 932, ester oils, e.g. methyl ester SU, oils based on renewable raw materials, e.g. refined rapeseed oil. Particularly preferred non-crosslinkable media (A) are the large class of hydrocarbons, polyether oils and solvents according to DIN 55 945, with the exception of toluene.

The composition used according to the invention preferably contains 0.1 to 90 wt. %, more preferably 1 to 50 wt. % and still more preferably 2 to 30 wt. % of the microgel (B), referred to the total amount of the composition.

The composition used according to the invention furthermore preferably contains 10 to 99.9 wt. %, more preferably 50 to 99 wt. %, still more preferably 70 to 98 wt. % and even more preferably 75 to 95 wt. % of the organic medium (A).

The composition used according to the invention preferably consists of the organic non-crosslinkable medium (A) and the microgel (B) and optionally the further components listed hereinafter. It is preferred that water is not present, and the compositions according to the invention preferably contain less than 0.8 wt. %, more preferably less than 0.5 wt. % of water. It is most particularly preferred that water is excluded (<0.1 wt. %). Due to production conditions this is generally the case with the compositions according to the invention.

The composition used according to the invention may in addition contain fillers, pigments and additives such as dispersing agents, oxidation protection additives and extreme pressure and wear protection additives, lubricants, friction modifiers, detergent/dispersement additives, foam inhibitors, pour point depressants, coupling agents, preservative active constituents, colorants, antistatics, deaerating agents, flow agents, flow improvers, auxiliary substances for substrate wetting, anti-settling agents, auxiliary substances to control substrate wetting and to control conductivity, de-emulsifiers, corrosion protection additives, non-ferrous metal deactivators, coefficient of friction modifiers, etc. (W. J. Bartz, Additive in Schmierstoffen 1994 expert verlag Renningen-Malmsheim).

Particularly suitable pigments and fillers are for example: organic pigments, silicate fillers such as kaolin, talcum, carbonates such as calcium carbonate and dolomite, barium sulphate, metal oxides such as zinc oxide, calcium oxide, magnesium oxide, aluminum oxide, highly dispersed silicic acids (precipitated and thermally produced silicic acids), metal hydroxides such as aluminum hydroxide and magnesium hydroxide, as well as further rubber gels based on polychloroprene and/or polybutadiene that have a high degree of crosslinking and particle sizes of 5 to 1000 nm.

The aforementioned fillers may be used alone or as a mixture. In a particularly preferred embodiment of the method at most 5 parts by weight of rubber gel (B), optionally together with 0 to 1 part by weight of filler, and 94 to 99.5 parts by weight of the liquid non-crosslinkable medium (A) are used to produce the compositions employed according to the invention.

The compositions used according to the invention may contain further auxiliary substances such as anti-ageing agents, heat stabilizers, light protection agents, ozone protection agents, processing auxiliaries, plasticizers, tackifiers, blowing agents, colorants, waxes, diluents/extenders, organic acids, as well as filler activators such as for example trimethoxysilane, polyethylene glycol, or other substances known in the described industries.

The auxiliary substances are employed in conventional amounts, which are governed inter alia according to the intended use. Conventional amounts are for example from 0.1 to 50 wt. %, referred to the used amounts of liquid medium (A) and rubber gel (B).

In a preferred embodiment the composition used according to the invention is produced by mixing at least one non-crosslinkable, organic medium (A) that at a temperature of 120° C. has a viscosity of less than 30,000 mPas, and at least one dry microgel powder (B) (preferably less than 1 wt. %, more preferably less than 0.5 wt. % of volatile fractions (no microgel latices are employed when mixing the components (A) and (B)) that is preferably not crosslinked by high energy radiation, by means of an homogenizer, a bead mill, a triple roller, a single-shaft or multishaft extruder screw, an Ultra-Turrax machine, a kneader and/or a dissolver, preferably by means of an homogenizer, a bead mill or a triple roller.

As regards the viscosity of the composition to be produced, the kneader, in which preferably only extremely highly viscous (almost solid to solid) compositions can be employed, is used only to a very limited extent, i.e. only in special cases.

A disadvantageous of the triple roller is the comparatively restricted viscosity range (tendency to thick compositions), low throughput and the non-closed mode of operation (poor operational protection).

The homogenization of the compositions used according to the invention is particularly preferably carried out by means of an homogenizer or a bead mill. The disadvantage of the bead mill is the high cleaning expenditure, expensive product exchange of the compositions that can be used, as well as the abrasion of the grinding spheres and grinding apparatus.

The homogenization of the compositions used according to the invention is therefore most preferably carried out by means of an homogenizer. The homogenizer enables both thin and thick compositions to be processed at high throughputs (high flexibility). Product exchanges are comparatively quick and can be performed without any problem.

It is surprising and novel that it is possible, in particular by adding microgels to lubricants or compositions based on lubricants, to modify the temperature-dependent rheological behavior in such a way that a very significant improvement in the temperature behavior compared to the pure lubricant is achieved, in which connection it is also possible to obtain shear-stable and/or transparent combinations.

The microgels (B) can be dispersed up to the level of primary particles in the non-crosslinkable organic media.

The dispersion of the microgels (B) in the liquid medium (A) is preferably carried out in the homogenizing valve in a homogenizer (see FIG. 1).

In the process that is preferably used according to the invention agglomerates are comminuted into aggregates and/or primary particles. Agglomerates are physically separable units during the dispersion of which no change in the primary particle size takes place.

The FIGURE (FIG. 1) shows the basic product, valve seat, valve and homogenized product.

The product to be homogenized, which contains microgel and non-crosslinkable organic medium, enters the homogenizing valve at a slow speed and is accelerated to high speeds in the homogenizing gap. The dispersion takes place behind the gap mainly on account of turbulence and cavitation (William D. Pandolfe, Peder Baekgaard, Marketing Bulletin of the APV Homogenizer Group—"High-pressure homogenizer processes, product and applications").

The temperature of the composition used according to the invention when fed to the homogenizer is expediently −40° to 140° C., preferably 20° to 80° C.

The composition used according to the invention that is to be homogenized is expediently homogenized in the apparatus at a pressure of 20 to 4000 bar, preferably 100 to 4000 bar, more preferably 200 to 4000 bar, still more preferably 200 to 2000 bar and most particularly preferably 500 to 1500 bar.

The number of passes is governed by the desired dispersion quality and may vary between 1 and 20, preferably 1 to 10 and more preferably 1 to 4 passes.

The compositions used according to the invention have a particularly fine particle distribution, which is achieved especially with the homogenizer, which is also extremely advantageous as regards the flexibility of the process in terms of varying viscosities of the liquid media and of the resulting compositions and necessary temperatures as well as the dispersion quality.

The invention is illustrated in more detail hereinafter with the aid of the following examples. The invention is obviously not restricted to these examples.

EXAMPLES

Example 1

Transparency and Phase Separation as Well as Theological and Tribological Properties of the Lubricants Consisting of the Combination of 2% Microgel/Non-Crosslinkable Organic Medium In Example 1 described hereinafter it is shown that by using microgels based on SBR (styrene butadiene rubber) and BR (butadiene rubber) compositions according to the invention are obtained that exhibit specific characteristics as regards transparency, separation stability and in particular temperature-dependent Theological properties. From this follows inter alia the use of the composition employed according to the invention, as a functional rheological additive. Microgels that have little influence on viscosity at low temperatures, i.e. ca. room temperature (20° C.) and below but that greatly increase the viscosity at high temperatures, i.e. 100° C. and above, are favorable preconditions for their use in lubricants. These microgels are in particular unmodified microgels based on SBR.

The composition is given in a generalized form in the following table:

| | | |
|---|---|---|
| 1. | Lubricating oil | 98% |
| 2. | Microgel | 2% |
| | Total | 100% |

Shell Catenex S 932 is a paraffinic, highly refined mineral oil from Deutsche Shell GmbH.

Baylube 68CL is a polyether from Rhein Chemie Rheinau GmbH.

Nynas T 110 is an hydrogenated naphthenic oil from Nynas Naphthenics AB.

Infineum C 9237 is a monosuccinimide/bisuccinimide that contains polyolefin amide alkyleneamine in highly refined mineral oil.

Micromorph 5P is a crosslinked rubber gel with an OH number of 4, based on SBR from Rhein Chemie Rheinau GmbH.

Micromorph 5P consists of 40 wt. % styrene, 60 wt. % butadiene and 2.5 wt. % dicumyl peroxide.

Mikrogel OBR 1210 is a crosslinked, surface-modified rubber gel (laboratory product) based on SBR from Lanxess AG. Micromorph 4P and 5P are crosslinked, non-surface-modified rubber gels based on SBR from Rhein Chemie Rheinau GmbH.

OBR 1326K is a crosslinked, surface-modified rubber gel (laboratory product) based on BR (butadiene rubber) from Lanxess AG (Table 1).

The microgels are produced in the same way as described in the production examples for Micromorph 4P and OBR 1326K.

TABLE 1

Composition of the microgels OBR 1210, OBR 1326K, Micromorph 4P and Micromorph 5P.

| Identification | Butadiene | Styrene | TMPTMA | HEMA | Remarks |
|---|---|---|---|---|---|
| OBR 1210 | 51.6 | 34.4 | 12.5 | 1.5 | SBR |
| OBR 1326K | 87 | — | 3 | 10 | BR |
| Micromorph 4P | 61 | 39 | — | — | SBR |
| Micromorph 5P | 61 | 39 | — | — | As Micromorph 4P; but 2.5 DCP[1)] |

[1)]DCP—dicumyl peroxide

The characteristic data of the SBR gels and of the NBR gel are summarized in Table 2.

TABLE 2

Properties of OBR 1210, OBR 1326K, Micromorph 4P and Micromorph 5P.

| | | Analytical Data | | | | | | | | |
|---|---|---|---|---|---|---|---|---|---|---|
| Microgel | Gel Type | $d_{50}$ [nm] | $O_{spec.}$ [$m^2$/g] | Particle Density [g/ml] | $T_g$ [° C.] | Gel [wt. %] | SI | OH No. [mg KOH/g] | Acid No. | $T_g$ Stage DSC/2$^{nd}$ heating [° C.] |
| OBR 1210 | SBR | 60 | 102 | 0.993 | −20.0 | 95.4 | 4.9 | 4 | 1 | — |
| OBR 1326K | SBR | 49 | 123 | 0.928 | −77.0 | 97 | 8 | 41 | 5 | 8 |
| Micromorph 4P | SBR | 57 | 111 | — | −15.0 | 94.6 | 9.0 | 8 | 6 | — |
| Micromorph 5P | SBR | 57 | 111 | — | — | 92 | <5 | 4 | 1 | — |

The symbols and wording in the table have the following meanings:

$d_{50}$: The diameter $\bar{d}_{50}$ is defined according to DIN 53 206 as the mean value. Here it represents the mean particle diameter of the particles in the latex. The particle diameter of the latex particles was determined in this case by means of ultracentrifugation (W. Scholtan, H. Lange, "Bestimmung der Teilchengrößenverteilung von Latices mit der Ultrazentrifuge", [*Determination of the Particle Size Distribution of Latices using an Ultracentrifuge*], Kolloid-Zeitschrift und Zeitschrift für Polymere (1972) Vol. 250, Issue 8). The diameter data in the latex and for the primary particles in the compositions according to the invention are practically identical, since the particle size of the microgel particles does not change in the production of the composition according to the invention.

$O_{spec.}$: Specific Surface in $m^2/g$

Tg: Glass Transition Temperature

A DSC-2 instrument from Perkin-Elmer was used to determine Tg and ΔTg.

Glass Transition Range:

The glass transition range was determined as described above.

Swelling Index SI

The swelling index SI was determined as follows:

The swelling index is calculated from the weight of the solvent-containing microgel caused to swell in toluene at 23° C. for 24 hours and the weight of the dry microgel:

SI=wet weight of the microgel/dry weight of the microgel

To determine the swelling index, 250 mg of the microgel are caused to swell in 25 ml of toluene for 24 hours while shaking. The (wet) gel swollen with toluene is weighed after centrifugation at 20,000 rpm and is then dried at 70° C. to constant weight and weighed once more.

OH Number (Hydroxyl Number)

The OH number (hydroxyl number) is determined according to DIN 53240, and corresponds to the amount of KOH in mg that is equivalent to the amount of acetic acid that is released in the acetylation of 1 g of substance with acetic anhydride.

Acid Number

The acid number is determined as already mentioned above according to DIN 53402 and corresponds to the amount of KOH in mg that is required to neutralize 1 g of the polymer.

Gel Content

The gel content corresponds to the fraction insoluble in toluene at 23° C. The gel content is obtained from the quotient of the dried residue and the weighed-out amount, and is specified in weight percent.

Checking the Homogeneity:

The samples were checked visually for separation one week after their preparation.

Checking the Transparency:

The transparency of the samples was checked visually. Samples that exhibited separation or flocculation were stirred before the evaluation.

Production Example 1

OBR 1326K (Directly Crosslinked Microgels)

The following monomers are used for the production of the microgels: butadiene, trimethylolpropane trimethacrylate (TMPTMA) and hydroxyethyl methacrylate (HEMA).

252 g of the emulsifier Dresinate/Edinor were dissolved in 10.762 kg of water and added to a 40 l capacity autoclave. The autoclave was evacuated three times and charged with nitrogen. 4893 g of butadiene, 186 g of trimethylolpropane trimethacrylate (90%) and 563 g of hydroxyethyl methacrylate (96%) were then added. The reaction mixture was heated to 30° C. while stirring. An aqueous solution consisting of 95 g of water, 950 mg of ethylenediamine-tetraacetic acid (Merck-Schuchardt), 760 mg of iron(II) sulfate*$7H_2O$, 1.9 g of Rongalit C (Merck-Schuchardt) as well as 2.95 g of trisodium phosphate*$12H_2O$ was then metered in.

The reaction was started by addition of 3.15 g of p-menthane hydroperoxide (Trigonox NT 50 from Akzo-Degussa) in 200 g of water, followed by rinsing with 185 g of water. After a reaction time of 2.5 hours the reaction temperature was raised to 40° C. After a further 1 hour reaction time the reaction mixture was post-activated with 350 mg of p-menthane hydroperoxide (Trigonox NT 50) that had been dissolved in an aqueous solution of 25 g of water and 1.25 g of Mersolate K30/95. At the same time the polymerization temperature was raised to 50° C. When a polymerization conversion of >95% had been reached, the polymerization was stopped by adding an aqueous solution of 53 g of diethylhydroxylamine dissolved in 100 g of water. Unreacted monomers were then removed from the latex by stripping with steam.

The latex was filtered and stabilizer was added as in Example 2 of U.S. Pat. No. 6,399,706, following which the latex was coagulated and dried.

The gels were characterized in the latex state by means of ultracentrifugation (diameter and specific surface) and also as solid product, in terms of the solubility in toluene (gel content, swelling index/SI), by acidimetric titration (OH number and COOH number) and by means of DSC (glass transition temperature/Tg and glass transition range).

Production Example 2

Micromorph 4P (Microgels Crosslinked by Peroxide)

The production of the microgel was carried out by crosslinking an SBR latex containing 39 wt. % of incorporated styrene (Krylene 1721 from Bayer France) in latex form with 1 phr dicumyl peroxide (DCP).

The crosslinking of Krylene 1721 with dicumyl peroxide was carried out as described in Examples 1)-4) of U.S. Pat. No. 6,127,488, 1 phr of dicumyl peroxide being used for the crosslinking.

Before use the microgel is dried to constant weight in a vacuum drying cabinet from Haraeus Instruments, Vacutherm VT 6130 type, at 100 mbar.

Production of the Compositions that can be Used According to the Invention

For the production of the composition that can be used according to the invention the respective lubricating oils were first taken and the respective microgel or an already dispersed "concentrate" based on the same microgel and non-crosslinkable organic medium was added while stirring using a dissolver, and in the case of a concentrate was treated in addition with an Ultra-Turrax machine. The mixture was left to stand for at least one day and was then worked up with the homogenizer. The composition according to the invention was added at room temperature to the homogenizer and fed in batches 2 to 6 times through the homogenizer at a pressure of 900 to 1000 bar. During the first pass the microgel paste heated up to ca. 40° C., and in the second passage to ca. 70° C. The microgel paste was then cooled to room temperature by being left to stand, and the procedure was repeated until the desired number of passes had been achieved.

The rheological properties of the composition were determined according to DIN 51562 with Ubbelohde capillary viscosimeters. The Theological properties of the composition were also measured with an MCR300 rheometer from Physica. A plate/sphere system, CP50-20, was used as measurement body. The measurements were carried out at 20° C., 40° C. or 100° C.

Some measurement results for the microgels described above are shown in the following Table 3. The characteristic number shown in Table 3 is calculated according to formula I given above.

TABLE 3

Kinematic viscosities of microgel (OBR 1210, OBR 1326K, Micromorph 4P and Micromorph 5P)-containing non-crosslinkable organic media (Baylube 68CL, Nynas T110, Shell Catenex S 932).

| Non-crosslinkable organic medium | Microgel | Viscosity, 40° C. [$mm^2/s$] | Viscosity, 100° C. [$mm^2/s$] | Characteristic no. according to Formula I [ ] |
|---|---|---|---|---|
| Baylube 68 CL | — | 76.1 | 15.5 | 212 |
| Baylube 68 CL | OBR 1210 | 119 | 24.8 | 236 |
| Shell Catenex S 932 | — | 57.6 | 7.6 | 94 |
| Shell Catenex S 932 | Micromorph 4P | 111.8 | 15.0 | 137 |
| Nynas T 110 | — | 116.1 | 9.2 | 21 |
| Nynas T 110 | Micromorph 5P | 190 | 17.4 | 98 |
| Nynas T 110 | Micromorph 5P/ infineumC9327 | 202.5 | 20.9 | 121 |
| Nynas T 110 | OBR1326K/ InfineumC9327 | 146.2 | 11.55 | A:50 |

From Table 3 it is clear that there are many compositions that on the one hand are based on different lubricating oils and on the other hand exhibit a temperature dependence of the viscosity that is significantly better than that of the pure lubricant. The mixture containing OBR 1326K should be highlighted, which does not settle out and is completely clear after filtration, the microgel content remaining constant within the limits of experimental error.

In the following Table 4 it is also shown that microgels are suitable for optimizing non-crosslinkable organic media as regards their temperature-dependent rheological behavior, in which connection it is possible to obtain shear-stable combinations of microgel and non-crosslinkable organic medium.

TABLE 4

| Microgel/percent/ non-crosslinkable organic medium | Viscosity, 100° C. before pumping test 1 [cSt] | Viscosity, 100° C. after pumping test 1 (250 cycles) [cSt] | Relative viscosity loss rel, 1 [%] |
|---|---|---|---|
| Baylube68CL/2/ OBR 1210 | 25.8 | 23.9 | −7.4 |
| Nynas T 110/2/ Micromorph 5P | 17.4 | 17.5 | +0.6 |

The measured values surprisingly show an improvement in the rheological behavior over a wide temperature range compared to the microgel-free reference compound (respective lubricant), expressed by the aforedescribed characteristic number.

In addition the described combinations can exhibit properties such as excellent shear stability and outstanding transparency, which means that they are commercially very interesting products.

For example, the combination Nynas T110-Micromorph 5P has an excellent shear stability in the pumping test based on DIN 51382.

The described or similar compositions may advantageously be used in lubricants, such as for example engine oils and gear oils, hydraulic oils and further (high temperature) industrial oils, metal treatment fluids, chainsaw oils, etc., whereby these may also be improved as regards their low temperature properties.

What is claimed is:

1. A process for modifying the temperature-dependent behavior of a non-crosslinkable organic media (A) comprising:

adding crosslinked microgels (B) to the non-crosslinkable organic media (A), thereby forming a modified non-crosslinkable organic media composition capable of use at temperatures of at least 100° C., wherein the non-crosslinkable organic medium (A) is selected from the group consisting of:

saturated hydrocarbons, aromatic hydrocarbons, mineral oils, synthetic hydrocarbon oils, natural ester oils, synthetic ester oils, polyether oils, polyether ester oils, and phosphoric acid esters, further wherein the non-crosslinkable organic medium (A) has a viscosity of less than 200 mPas at a temperature of 120° C., wherein the non-crosslinkable organic medium (A) has a characteristic number that is increased by at least 10% via the adding of the crosslinked microgels (B), said characteristic number being calculated according to the formula (I):

$$\text{characteristic number}=[(L-U)/(L-H)]\times 100 \quad \text{(I)}$$

where L is the kinematic viscosity at 40° C. of a reference medium with a characteristic number 0, which has the same kinematic viscosity at 100° C. as the non-crosslinkable organic medium (A), H is the kinematic viscosity at 40C of a reference medium with a characteristic number 100, which has the same kinematic viscosity at 100° C. as the non-crosslinkable organic medium (A), and U is the kinematic viscosity at 40° C. of the non-crosslinkable organic medium (A), and further wherein the crosslinked microgels (B) comprise primary particles having an average particle diameter of 5 to 500 nm.

2. A process for modifying the temperature-dependent behavior of a non-crosslinkable organic media (A) comprising:

adding crosslinked microgels (B) to the non-crosslinkable organic media (A), thereby forming a modified non-crosslinkable organic media composition capable of use at temperatures of at least 100° C., wherein the non-crosslinkable organic medium (A) is selected from the group consisting of:

saturated hydrocarbons, aromatic hydrocarbons, mineral oils, synthetic hydrocarbon oils, natural ester oils, synthetic ester oils, polyether oils, polyether ester oils, and phosphoric acid esters, wherein the non-crosslinkable organic medium (A) has a characteristic number that is increased by at least 10% via the adding of the crosslinked microgels (B), said characteristic number being calculated according to the formula (I):

$$\text{characteristic number}=[(L-U)/(L-H)]\times 100 \quad \text{(I)}$$

where L is the kinematic viscosity at 40° C. of a reference medium with a characteristic number 0, which has the same kinematic viscosity at 100° C. as the non-crosslinkable organic medium (A), H is the kinematic viscosity at 40C of a reference medium with a characteristic number 100, which has the same kinematic viscosity at 100° C. as the non-crosslinkable organic medium (A), and U is the kinematic viscosity at 40° C. of the non-crosslinkable organic medium (A), and further wherein the crosslinked microgels (B) comprise primary particles having an approximately spherical geometry.

3. A process for modifying the temperature-dependent behavior of a non-crosslinkable organic media (A) comprising:

adding crosslinked microgels (B) to the non-crosslinkable organic media (A), thereby forming a modified non-crosslinkable organic media composition capable of use at temperatures of at least 100° C., wherein the non-crosslinkable organic medium (A) is selected from the group consisting of:

saturated hydrocarbons, aromatic hydrocarbons, mineral oils, synthetic hydrocarbon oils, natural ester oils, synthetic ester oils, polyether oils, polyether ester oils, and phosphoric acid esters, wherein the non-crosslinkable organic medium (A) has a characteristic number that is increased by at least 10% via the adding of the crosslinked microgels (B), said characteristic number being calculated according to the formula (I):

$$\text{characteristic number}=[(L-U)/(L-H)]\times 100 \quad \text{(I)}$$

where L is the kinematic viscosity at 40° C. of a reference medium with a characteristic number 0, which has the same kinematic viscosity at 100° C. as the non-crosslinkable organic medium (A), H is the kinematic viscosity at 40C of a reference medium with a characteristic number 100, which has the same kinematic viscosity at 100° C. as the non-crosslinkable organic medium (A), and U is the kinematic viscosity at 40° C. of the non-crosslinkable organic medium (A), and further wherein the crosslinked microgels (B) comprise a plurality of primary particles and wherein a deviation of the diameter of an individual primary particle is less than 250%, said diameter of an individual primary particle defined as being equal to $$[(d1-d2)/d2]\times 100,$$

wherein d1 and d2 are two arbitrary diameters of an arbitrary layer of the primary particles and d1>d2.

4. The process according to claims 2 or 3, wherein the primary particles have an average particle diameter of 5 to 500 nm.

5. The process according to claim 3, wherein the deviation of the diameter of an individual primary particle is less than 50%.

6. The process according to claims 2 or 3, wherein the temperature-dependent behavior of the modified non-crosslinkable organic medium composition demonstrates an increase of kinematic viscosity at 40° C. and 100° C. as compared to the non-crosslinkable organic media (A).

7. The process according to claims 2 or 3, wherein the non-crosslinkable organic medium (A) has a viscosity of less than 1000 mPas at a temperature of 120° C.

8. The process according to claims 1, 2 or 3, wherein the primary particles have an average particle size of less than 99 nm.

9. The process according to claims 1, 2 or 3, wherein the crosslinked microgels (B) comprise insoluble fractions of at least about 70 wt. % in toluene at 23° C.

10. The process according to claims 1, 2 or 3, wherein the crosslinked microgels (B) have a swelling index of less than about 120 in toluene at 23° C.

11. The process according to claims 1, 2 or 3, wherein the crosslinked microgels (B) have a glass transition temperature of −100° C. to +120° C.

12. The process according to claims 1, 2 or 3, wherein the crosslinked microgels (B) have a glass transition range width of greater than about 5° C.

13. The process according to claims 1, 2 or 3, wherein the crosslinked microgels (B) are obtained by emulsion polymerization.

14. The process according to claims 1, 2 or 3, wherein the crosslinked microgels (B) comprise rubber.

15. The process according to claims 1, 2 or 3, wherein the crosslinked microgels (B) comprise homopolymers and/or random copolymers.

16. The process according to claims 1, 2 or 3, wherein the crosslinked microgels (B) are free of functional groups.

17. The process according to claims 1, 2 or 3, wherein the crosslinked microgels (B) comprise one or more functional groups.

18. The process according to claim 17, wherein the one or more functional groups are selected from the group consisting of: hydroxyl, epoxy, amine, acid amide, acid anhydride, isocyanate, an unsaturated carbon-carbon bound group, and mixtures thereof.

19. The process according to claims 1, 2 or 3, wherein the weight ratio of the non-crosslinkable organic medium (A) to the crosslinked microgels (B) is from 50:50 to 99.9:0.1.

20. The process according to claims 1, 2 or 3, wherein the weight ratio of non-crosslinkable organic medium (A) to the crosslinked microgels (B) is from 70:30 to 99.7:0.3.

21. The process according to claims 1, 2 or 3, wherein the modified non-crosslinkable organic medium composition further comprises one or more lubricant additives.

22. The process according to claim 21, wherein the one or more lubricant additives are selected from the group consisting of: oxidation inhibitors, corrosion inhibitors, extreme pressure and wear protection additives, solid lubricants, friction modifiers, detergent/dispersant additives, dispersing agents, foam inhibitors, pour point depressants, coupling agents, preservatives, pigments, dyes and anti-statics.

23. The process according to claims 1, 2 or 3, wherein the adding of the crosslinked microgels (B) to the non-crosslinkable organic medium (A) is effected by means of a homogenizer, a bead mill (agitator ball mill), a triple roller, a single-shaft or multi-shaft extruder screw, a kneader, and/or a dissolver.

24. The process according to claims 1, 2 or 3, wherein the weight ratio of non-crosslinkable organic medium (A) to the crosslinked microgels (B) is from 88:12 to 98:2.

* * * * *